US011457324B2

(12) United States Patent
Leander et al.

(10) Patent No.: US 11,457,324 B2
(45) Date of Patent: Sep. 27, 2022

(54) AUDIO CONTENT-BASED SPEAKER CONTROL

(71) Applicant: Axis AB, Lund (SE)

(72) Inventors: Ulf Leander, Lund (SE); Henrik Liberg, Lund (SE)

(73) Assignee: AXIS AB, Lund (SE)

( * ) Notice: Subject to any disclaimer, the term of this patent is extended or adjusted under 35 U.S.C. 154(b) by 0 days.

(21) Appl. No.: 17/335,290

(22) Filed: Jun. 1, 2021

(65) Prior Publication Data

US 2022/0070598 A1 Mar. 3, 2022

(30) Foreign Application Priority Data

Aug. 27, 2020 (EP) ..... 20193079

(51) Int. Cl.

| | |
|---|---|
| ***H04R 29/00*** | (2006.01) |
| ***G10L 19/00*** | (2013.01) |
| ***G10L 25/21*** | (2013.01) |
| ***G10L 25/51*** | (2013.01) |
| ***H04R 3/04*** | (2006.01) |

(52) U.S. Cl.

CPC ..... *H04R 29/001* (2013.01); *G10L 19/00* (2013.01); *G10L 25/21* (2013.01); *G10L 25/51* (2013.01); *H04R 3/04* (2013.01); *H04R 2430/01* (2013.01)

(58) Field of Classification Search

None

See application file for complete search history.

(56) References Cited

U.S. PATENT DOCUMENTS 7,643,894 B2 * 1/2010 Braithwaite ... H04N 21/234327 700/94

10,469,044 B1 11/2019 Hollabaugh et al.

(Continued)

FOREIGN PATENT DOCUMENTS

CN 105959866 A 9/2016

CN 110022515 A 7/2019

(Continued)

OTHER PUBLICATIONS

Extended European Search Report dated Mar. 25, 2021 for European Patent Application No. 20193079.9.

(Continued)

*Primary Examiner* — Paul W Huber

(74) *Attorney, Agent, or Firm* — Volpe Koenig

(57) ABSTRACT

Methods and apparatus, including computer program products, for controlling a speaker, which is electrically powered with a low-power source and connected to a short-term energy storage. Audio is received for playback on the speaker. A time-resolved power analysis of the audio is acquired and a time-resolved speaker power requirement required by a speaker playing back the audio is calculated. The time-resolved speaker power requirement is compared with a combined capacity of the low-power source and the short-term energy storage. One or more of: a dynamic range, a frequency range, and an output gain of a digital signal processor are adjusted such that the speaker power requirement meets the combined capacity of the low-power source and the short-term energy storage for the duration of a playback of the received audio on the speaker.

14 Claims, 2 Drawing Sheets

(56) References Cited

U.S. PATENT DOCUMENTS

| | | | | |
|---|---|---|---|---|
| 10,629,224 | B1 * | 4/2020 | Alonzo, III | G10L 25/72 |
| 2009/0226152 | A1 | 9/2009 | Hanes | |
| 2010/0290643 | A1 | 11/2010 | Mihelich et al. | |
| 2014/0123836 | A1 | 5/2014 | Vorobyev et al. | |
| 2016/0231794 | A1 | 8/2016 | Hansson et al. | |
| 2018/0206034 | A1 | 7/2018 | Serwy et al. | |
| 2019/0296842 | A1 | 9/2019 | Werbrouck | |
| 2019/0319999 | A1 | 10/2019 | Davison et al. | |
| 2020/0396106 | A1 * | 12/2020 | Christie | H04L 12/10 |
| 2021/0211104 | A1 * | 7/2021 | Kim | H04R 3/00 |

FOREIGN PATENT DOCUMENTS

| | | | |
|---|---|---|---|
| JP | 09-223938 | A | 8/1997 |
| WO | 2017/215657 | A1 | 12/2017 |

OTHER PUBLICATIONS

Partial European Search Report dated Jan. 25, 2021 for European Patent Application No. 20193079.9.

* cited by examiner

AUDIO CONTENT-BASED SPEAKER CONTROL

BACKGROUND

The present invention relates to audio rendering, and more specifically to adjusting digital signal processor (DSP) settings of a network connected speaker or amplifier system.

Audio devices are ubiquitous in today's society, ranging from personal audio devices, such as audio players and cell phones, to various types of speaker systems which deliver audio in a public setting, such as a shopping mall, a public transit station, etc. It is known that different music genres may be better perceived when listening to them using different audio presets. Therefore, some audio devices have dedicated buttons or other controls allowing a user to switch between different presets labeled "POP, "ROCK", "CLASSICAL", "VOICE," etc. These presets contain equalizers or filters and band compressor settings for a DSP to process the signal prior to the signal being sent to the amplifier and speaker drivers.

In some situations, a speaker may have a limited amount of power available and may not be able to generate the required sound over the entire frequency range. One such example is when a network connected speaker is powered via Power over Ethernet (PoE). This problem is sometimes addressed by various remedial measures, such as adding a high pass frequency filter or limiting the overall volume output by the speaker. However, such attempts often result in a quenched playback and a poor listening experience. Thus, it would be desirable to achieve an enhanced listening experience when rendering audio in a speaker that has a limited amount of power available.

SUMMARY

According to a first aspect, a method, in a computer system, for controlling a speaker powered with a low-power source, and being connected to a short-term energy storage includes:

receiving audio for playback on the speaker;

acquiring a time-resolved power analysis of the audio and calculating a time-resolved speaker power requirement required by a speaker playing back the audio;

comparing the time-resolved speaker power requirement with a combined capacity of the low-power source and the short-term energy storage; and adjusting one or more of: a dynamic range, a frequency range, and an output gain of a digital signal processor, such that the speaker power requirement meets the combined capacity of the low-power source and the short-term energy storage for the duration of a playback of the received audio on the speaker.

By using the techniques in accordance with the description hereinafter, it is possible to accommodate different types of audio to be rendered by speaker that has a limited amount of power available, and to prevent quenched playback—or even unexpected shutdowns of the device itself—due to insufficient power resources. The time-resolved power analysis details what power requirements are needed from the speaker. These requirements are compared with the combined power resources available from a low-power source (such as PoE) and a short term energy storage. Based on the results of this comparison, various adjustments can be made, for example, to the dynamic range, the frequency range (typically by filtering out the lowest frequencies, which require the most power), and/or the overall output gain. As a result, a much more pleasant listening experience can be had, and the risk of unexpected shutdowns can be minimized, or even eliminated.

According to one embodiment, the low-power source is a Power over Ethernet (PoE) power source. PoE describes any of several standard or ad hoc systems that pass electric power along with data on twisted pair Ethernet cabling, which allows a single cable to provide both data connection and electric power to devices, and is thus suitable for devices that include speakers for playing certain content provided through the data connection. There are several common techniques for transmitting power over Ethernet cabling, which are well known to those having ordinary skill in the art. The IEEE 802.3 standard describes a number of these. By using such standardized power delivery requirements, combined with data delivery, the various embodiments can be easily integrated with existing equipment. However, it should also be noted that there are other low-power sources that can be used and the teachings are not limited to PoE.

According to one embodiment, the short-term energy storage is located inside the speaker. This makes it possible to accomplish a compact and uniform speaker design and to minimize the number of connections to the speaker, for example, such that only a single PoE connection may be necessary. It also makes it possible to equip the speaker with interchangeable types of energy storages that have varying capacity, without changing the form factor of the speaker. For example, in a situation where a speaker is only used rarely to make announcements, a smaller energy storage may be needed, compared to a situation where the speaker is used to continuously play background music. The same type of speaker could be used in both situations, but the energy storage inside the speaker could differ.

According to one embodiment, the short-term energy storage includes one or more capacitors, or one or more batteries. Both of these are well known energy storage methods, and each has its own advantages. For example, a battery can store thousands of times more energy than a capacitor having the same volume, and supply that energy in a steady, dependable stream. However, batteries may not be able to recharge or provide energy as quickly as it is needed, and in such situations, a capacitor might be a better short-term energy storage option. Capacitors also do not lose their ability to hold a charge, as batteries tend to do. Thus, there are advantages and drawbacks to both alternatives, and by having both options available, an optimal configuration can be selected for the particular circumstances at hand.

According to one embodiment, acquiring a time-resolved power analysis of the audio includes retrieving the time-resolved power analysis of the audio from a database. That is, a database (for example, a cloud-database) may contain information for a given audio file, about how the power consumption of the audio file varies over time. The database can be accessed prior to playing the audio file on the speaker and any required speaker adjustments can be made before the audio is played, in order to avoid the potential problems listed above.

According to one embodiment, wherein acquiring a time-resolved power analysis of the audio includes performing a time-resolved power analysis of the audio as the audio is being played back on the speaker. That is, rather than obtaining a time-resolved power analysis from a database prior to playing an audio file, the audio file will be played and a time-resolved power analysis will be created as the audio is being played back on the speaker. This increases the flexibility of the system and makes it possible to play any type of audio, as it avoids the need to rely only on a limited selection of audio for which a time-resolved power analysis already exists in a database. And while there is a risk that the first time playback may not be perfect, and some "emergency adjustments" may need to be made on the fly, the system learns what the time-resolved power analysis looks like and can store that information such that the playback will be significantly better the next time the audio is played on the speaker.

According to one embodiment, the method can further include optimizing the acquired time-resolved power analysis to ensure that the power requirement of the received audio meets the combined capacity of the low-power source and the short-term energy storage during a subsequent playback of the received audio on the speaker. For example, if it is determined that the great majority of a song meets the limitations set by the combined capacity of the low-power source and the short-term energy storage, but that there are occasional "peaks" of power consumption that would exceed the available power, the time-resolved power analysis could be optimized such that these peaks are reduced to fall within the available power range. Alternatively, the sections of the audio right before the expected peaks could be optimized (e.g., by sufficiently reducing the dynamics of the audio for a certain time period before the expected peak) such that enough combined power would be available in the short-term energy storage and the low-power source when the peaks actually occur.

According to one embodiment, adjusting a frequency range includes applying a high-pass frequency filter to reduce a range of low frequency audio being played back on the speaker. Typically, the notes with the highest power requirement are the low frequency bass notes. Thus, by selectively applying a high pass frequency filter to the audio, the power requirement can be reduced. Application of a high pass frequency filter as a general concept is well-known to those having ordinary skill in the art. However, applying a high pass filter indiscriminatingly may not be ideal, especially in a music context, as it may adversely influence the listening experience. Therefore, applying the high pass frequency filter based on the time-resolved power analysis when power adjustments need to be made will create a much better listening experience, compared to what is currently possible.

According to one embodiment, adjusting a dynamic range includes performing a downward compression of the received audio. That is, audio that is loud (and thus requires significant power) can be attenuated such that the power requirement is reduced. Downward compression is also a well-known technique in the audio industry, and when it is paired with the time-resolved power analysis and applied sparingly, a good listening experience can be maintained, while reducing the power requirement to be within acceptable limits.

According to one embodiment, the method can further include continuously monitoring the combined capacity of the low-power source and the short-term energy storage; and performing the adjusting is continuously in response to the monitoring such that the power requirement of the speaker meets the combined capacity of the low-power source and the short-term energy storage for the duration of a playback of the received audio on the speaker. By continuously monitoring and adjusting, a better fine-tuning of the power consumption and better listening experience can be obtained.

According to one embodiment, the adjusting is performed in response to detecting an increasing or decreasing trend in the combined capacity of the low-power source and the short-term energy storage. For example, if during playback, the system notices that the application of a high pass filter results in the available power increasing, the frequency range of the high pass filter can be modified such that more lower frequencies are let through. After a while, the system may indicate that too much power is being consumed and that the power bank is being slowly depleted, and therefore readjust the high pass filter to reduce the low frequencies yet again. Thus, by monitoring such trends, a delicate adjustment can be made that is less disruptive compared to "quick" adjustments, thereby creating a better listening experience.

According to one embodiment, the adjusting is done based on the type of received audio. Various types of audio may require different types of adjustments. For example, a Heavy Metal song may not sound very good if a high pass filter was applied and a significant amount of the base disappeared, whereas a classical string quartet piece, a commercial soundtrack or announcements may be less impacted by the application of a high pass filter. For an evacuation message, it may be more important to maintain a high overall output volume, rather than having perfect sound quality over the entire frequency spectrum. Thus, by making adjustments based on the type of audio, an optimal listening experience can be accomplished for a variety of situations and audio content.

According to a second aspect, a system for controlling a speaker includes a speaker, a low-power source powering the speaker, a short-term energy storage connected to the speaker, a digital signal processor, a memory, and a processor. The memory contains instructions that when executed by the processor causes the processor to perform a method that includes:

receiving audio for playback on the speaker;

acquiring a time-resolved power analysis of the audio and calculating a time-resolved speaker power requirement required by a speaker playing back the audio;

comparing the time-resolved speaker power requirement with a combined capacity of the low-power source and the short-term energy storage; and adjusting one or more of: a dynamic range, a frequency range, and an output gain of the digital signal processor, such that the speaker power requirement meets the combined capacity of the low-power source and the short-term energy storage for the duration of a playback of the received audio on the speaker.

The system advantages correspond to those of the method and may be varied similarly.

According to a third aspect, a computer program for controlling a speaker electrically powered with a low-power source, and being connected to a short-term energy storage contains instructions corresponding to the steps of:

receiving audio for playback on the speaker;

acquiring a time-resolved power analysis of the audio and calculating a time-resolved speaker power requirement required by a speaker playing back the audio;

comparing the time-resolved speaker power requirement with a combined capacity of the low-power source and the short-term energy storage; and adjusting one or more of: a dynamic range, a frequency range, and an output gain of a digital signal processor, such that the speaker power requirement meets the combined capacity of the low-power source and the short-term energy storage for the duration of a playback of the received audio on the speaker.

The computer program involves advantages corresponding to those of the method and may be varied similarly.

The details of one or more embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION

As was described above, one goal with the various embodiments is to provide techniques for achieving better power management and an enhanced (e.g., louder) listening experience when rendering audio in a speaker that has a limited amount of power available. A time-resolved power analysis of the audio to be played on the speaker can be used to calculate a time-resolved speaker power requirement required by the speaker playing back the audio. The time-resolved speaker power requirement can be compared with a combined capacity of the low-power source and the short-term energy storage, adjustments to the dynamic range, frequency range, and/or an output gain of a digital signal processor can be made, such that the speaker power requirement meets the combined capacity of the low-power source and the short-term energy storage for the duration of a playback of the received audio on the speaker.

By using the techniques in accordance with the teachings described herein, it is possible to accommodate different types of audio to be rendered by speaker that has a limited amount of power available, and to prevent quenched playback—or even unexpected shutdown of the device itself—due to insufficient power resources. The availability of the short-term energy storage makes it possible to optimize the power usage by the speaker, such that at any instant, essentially all of the combined power available from the low-power source and the short-term energy storage is being used by the speaker, while at the same time an upper limit of the combined power available is not exceeded. As the combined power is higher than what would be achievable with the low-power source by itself, this results in a more pleasant listening experience, generally at a louder volume than what otherwise be available, and also minimizes or eliminates the risk of unexpected shutdown of the device. Various embodiments will now be described in detail by way of example and with reference to the drawings, in which FIG. 1 shows a schematic diagram 100 of a system for controlling a speaker, in accordance with one embodiment, and FIG. 2 shows a process 200 for controlling a speaker, in accordance with one embodiment.

Figure 1:
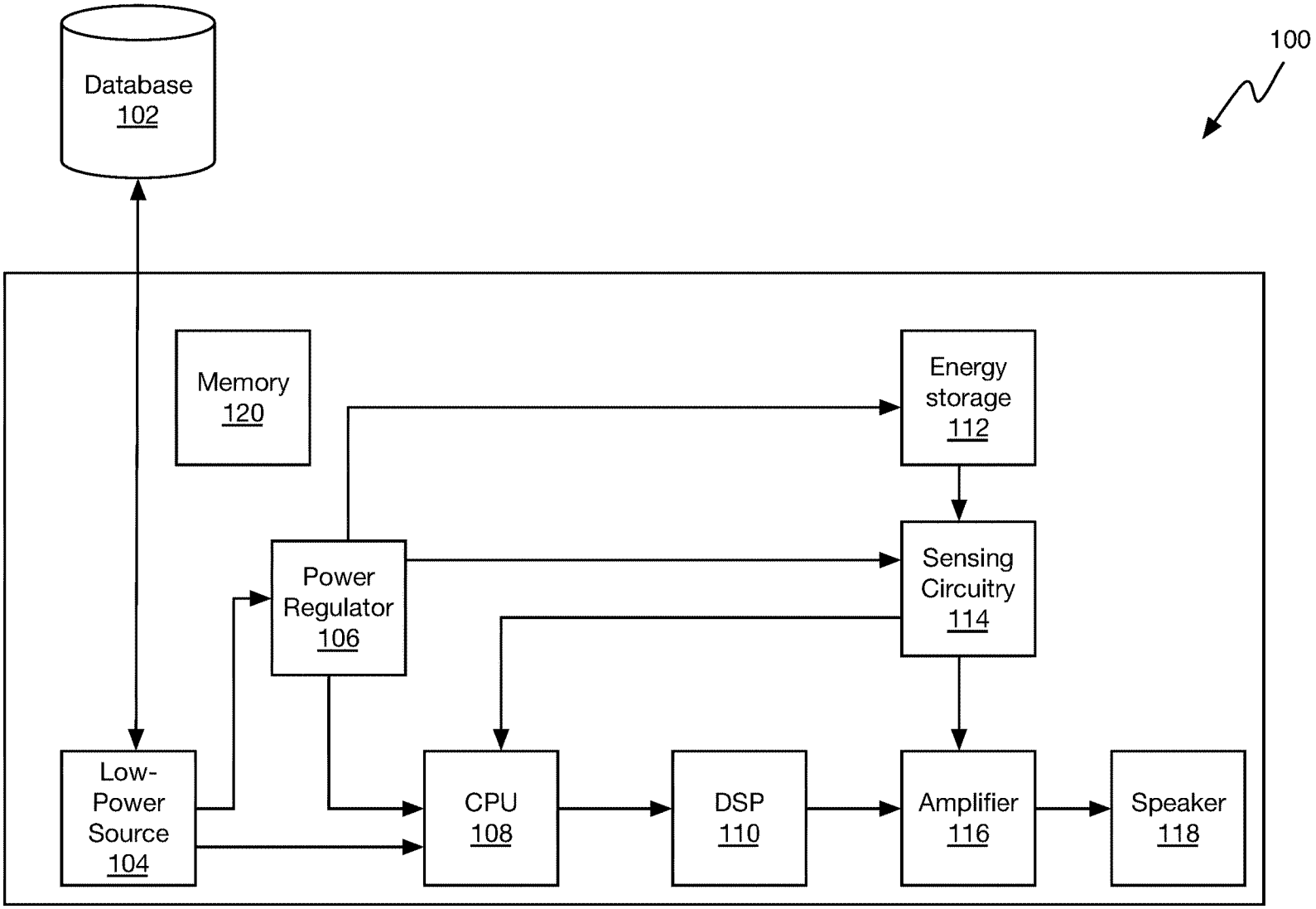
FIG. 1 shows a schematic diagram 100 of a system for controlling a speaker, in accordance with one embodiment.
Figure 2:
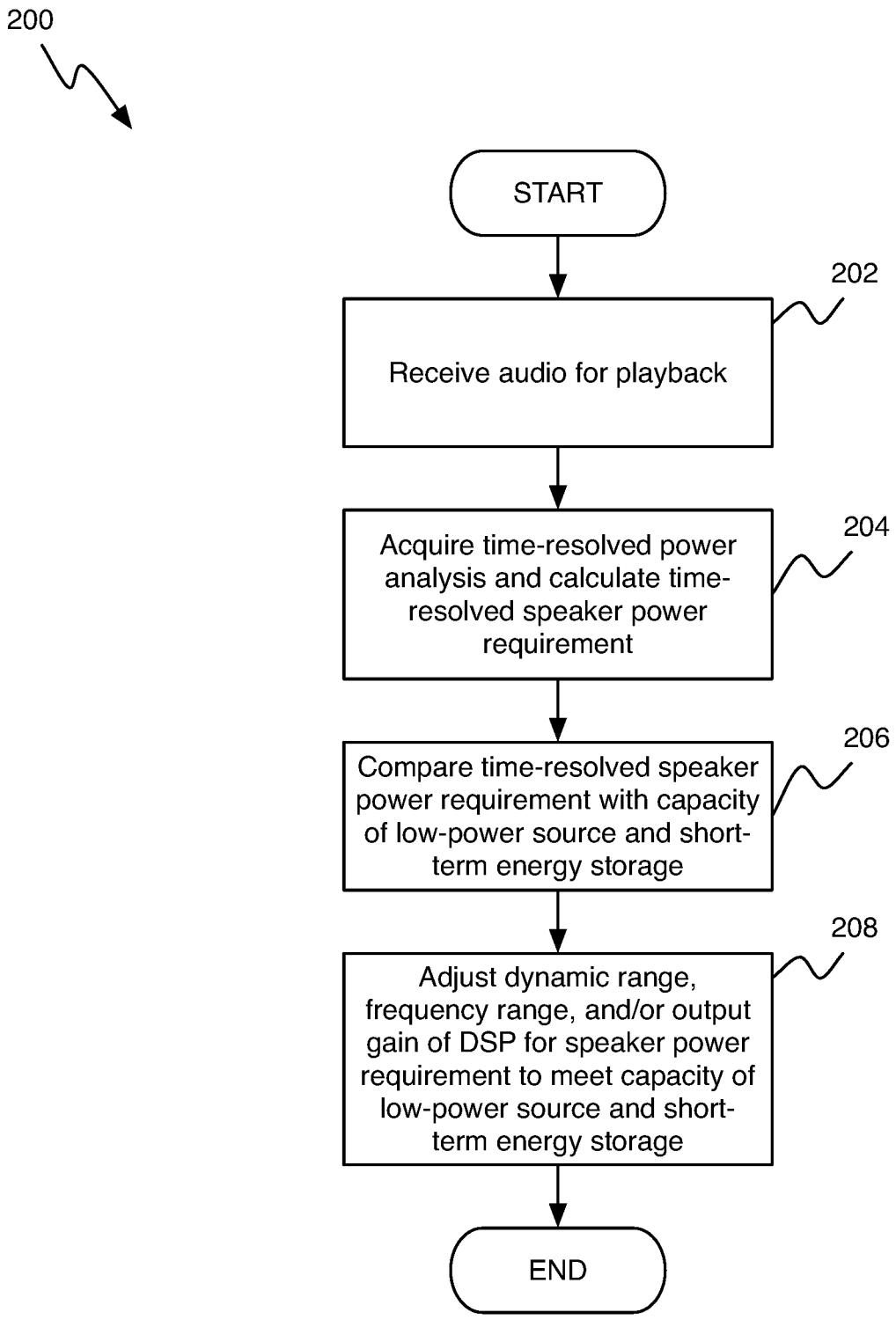
FIG. 2 shows a process 200 for controlling a speaker, in accordance with one embodiment.

As can be seen in FIG. 1, the system 100 includes a low-power source 104, a power regulator 106, a processor 108, a digital processor 110, a short-term energy storage 112, sensing circuitry 114, an amplifier 116 and a speaker 118. FIG. 1 also shows a database 102, which can either be internal to the system 100 in some embodiments, or be an external database, such as a cloud database, that can be accessed over a network in other embodiments. Each of these components will now be described individually, and their interactions will then be described with reference to FIG. 2.

The database 102 contains a time-resolved power analysis for audio that might be played on the speaker 118. In some embodiments, the database 102 contains only time-resolved power analyses, which can be retrieved using an identifier of the audio retrieved from some other source. In other embodiments, the database 102 can contain both the time-resolved power analyses and the audio itself. The time-resolved power analyses can be represented, for example, as digital signal processor (DSP) command sequences over the lifespan of the audio (e.g., the duration of a song). As the type of audio may vary significantly, e.g., from pre-recorded announcements to various type of music or even evacuation messages, so will the DSP command sequences. In essence, every song or piece of audio may have its own "fingerprint" describing how the DSP settings should change over time as the audio is being played. In some embodiments, several databases 102 may be used. For example, an internal database 102 may contain pre-recorded announcements and associated DSP command sequences that are specific to the establishment and that are played periodically (e.g., "Please maintain social distancing for the safety of you and your fellow shoppers."), whereas an external database 102 may contain various types of musical content played as continuously as background music. DSP command sequences typically require very little storage space, which simplifies integration with existing databases and systems.

The low-power source 104 can be a PoE source, as described above. PoE sources are well known to those having ordinary skill in the art. The use of PoE facilitates the integration of the system in accordance with various embodiments with existing power sources and devices. As mentioned above, PoE 104 can not only deliver power to the speaker, but also transmit data. However, it should be realized that PoE is merely one example of a low-power source and that there are other low-power sources 104 that can be used. Thus, the teachings herein should not be construed as being limited to PoE.

The PoE 104 is connected to a power regulator 106. The power regulator 106 converts the PoE voltage to an amplifier rail voltage for the amplifier 116, and a circuit supply voltage that is used to powering the CPU 110, DSP 108, memory and other electronics, such as an Ethernet interface, or parts of the user interface, LEDs, etc. The power regulator 106 limits the amount of power that is used by the components of the system, such that the available power is not exceeded. For example, a PoE class 3 device, in which the system 100 may be implemented, has a combined available power of 13 W. Assuming 3 W are needed to power the processor 108, DSP 110, sensing circuitry 114, and the power regulator 106 itself, and assuming a 3 W "margin" is to be maintained, this leaves 7 W for powering the amplifier 116. If this amount is exceeded, the processor 108 (or other components) may shut down unexpectedly, and the device will need to be rebooted, which is very disruptive. Thus, the power regulator 106 ensures that an adequate power supply is maintained to the different components of the system 100, and supplies power to replenish the short-term energy storage 112, power the amplifier 116, and the remaining components of the system 100. Typically, the power regulator 106 also reports the incoming current, voltage and power to the processor 108.

The processor 108 receives various types of information, such as the incoming current, voltage and power form the power regulator 106. The processor also receives DSP settings data for a particular piece of audio from the low-power source 104, and information from the sensing circuitry 114 about the power available in the energy storage 112 and the power delivered to the amplifier 116 by the power regulator 106. The processor 108 uses this information to send regulating commands to the DSP 110. If the audio content to be played is known and a DSP command sequence has been downloaded from the database 102, the processor 108 simply sends instructions to the DSP 110 that are in accordance with the downloaded DSP command sequence. If the audio content to be played does not have a DSP command sequence, the processor 108 primarily uses information provided by the sensing circuitry 112 which contains details regarding the status of the power bank 112 and the power provided by the power regulator 106, then issues commands to the DSP 110 based on that information. Further details about how this is done will be presented below with respect to FIG. 2.

The DSP 110 receives commands from the processor 108, as described above, and controls the power consumption of the amplifier 116 by changing various parameters. A non-exclusive list of examples of such parameters includes dynamic range control, high pass filter application, and output gain adjustments. Further details of how these parameters are used to control the amplifier 116 and the speaker 118 will also be presented below and with respect to FIG. 2. Lastly, the amplifier 116 and speaker 118, can be any type of amplifier and speaker, respectively, that are appropriate for use in conjunction with a low-power source 104. Many examples of such components are well known to those having ordinary skill in the art. It should be noted that the amplifier 116 and the speaker 118 need to have the ability to handle the highest transients (i.e., high amplitude, short-duration sound at the beginning of a waveform that occurs in phenomena such as musical sounds, noises or speech) that may be provided by the system 100. That is, the available power capacity of the amplifier 116 and speaker 118 should preferably be matched with the maximum power that can be delivered by the class of PoE that is being used by the system 100.

All the components of the system 100 can communicate with each other using standard or proprietary communication protocols. It should also be noted that while only one system component of each kind is shown in FIG. 1, for ease of illustration purposes, in a real life implementation, there may be several components. For example, there may be several energy storages 112, external/internal databases 108, or sensing circuitries 114, depending on the particular implementation. Thus, the system embodiment 100 shown in FIG. 1 should not be construed as to the number and types of system components.

A method 200 for controlling a speaker 118, will now be described by way of example and with reference to the flowchart of FIG. 2. As can be seen in FIG. 2, the process 200 starts by receiving audio for playback on the speaker, step 202. The audio can be retrieved from local or a remote storage using conventional techniques. Next, a time-resolved power analysis is acquired and a time-resolved speaker power requirement is calculated, step 204. As described above, the time-resolved power analysis can be acquired in two main ways; either by retrieval from the database 102 (for audio that has been played at some prior occasion) or by deriving the time-resolved power analysis the first time audio is played, by using the sensing circuitry 114 to monitor the power usage. The monitoring can be made, for example, though measuring the instant current going to the amplifier 116 from the short-term energy storage 112 and the PoE connection, and by feedback from the processing blocks of the DSP 110. The calculations involved in performing these operations are made by the processor 108.

Next, the time-resolved speaker power requirement is compared with the combined available capacity in the low-power source and the short-term energy storage, step 206. This comparison is also done by the processor 108. In the first embodiment, the comparison can be made in a simple way before the audio is played. For example, by knowing the available energy level of the short-term energy storage 112, and characteristics about how quickly the short-term energy storage 112 is depleted and recharged, respectively, and comparing this to the retrieved time-resolved power analysis, it is possible to determine whether the audio can be played without having to make any adjustments to the DSP settings, e.g., by examining how much of the audio exceeds a certain power level (a certain crest factor and a certain size/length of peaks may be tolerated without adjusting any DSP settings).

In the second embodiment, rather than making these calculations by the processor 108 before the audio is played, they are made "on the fly" as the audio is being played, typically though using the data received from the sensing circuitry 114. For example, the DSP 110 can provide feedback, together with measuring the instant current going to the amplifier 116 from the short-term energy storage 112 and the PoE connection, and this may provide information as to any DSP adjustments that need to be made.

Based on the results of the comparison in step 206, the processor 108 will send commands to the DSP 110 to adjust one or more of the dynamic range, frequency range and output gain, in order to adjust the speaker power to ensure that the combined capacity of the lower-power energy source 104 and the short-term energy storage 112 can be met, step 208. There is a variety of ways to make such adjustments, all of which fall within the realm of a person having ordinary skill in the art. A few of these will now be described by way of example.

Typically, it is desirable to maintain a consistent volume throughout the playing of the audio as this is one of the more noticeable features to a listener and intermittent volume adjustments up or down would generally be experienced as disturbing. Therefore, as a first measure, it is generally desired to instruct the DSP 110 to adjust the sound profile in order to reduce the power consumption of the amplifier 116. As described above, when the time-resolved power analysis of the audio and the specific properties of the system components are known, this adjustment of the sound profile can be done in advance of playing the audio on the speaker 118. As also described, in other embodiments, the adjustments of the sound profile can be done dynamically, for example, by monitoring the status of the short-term energy storage 112 and adjust the DSP 110 settings such that the short-term energy storage 112 is never depleted. This may result in a bass that comes and goes. In yet another embodiment, the adjustment of the DSP 100 settings can be done "on the fly" by analyzing the audio to be played a little in advance (e.g., one or two measures, half a track, or a full track) and determining any adjustments to be made before the audio is actually played on the speaker 118.

The DSP 110 typically offers a variety of "tools" for making adjustments to the sound profile. As was described above, one such tool involves applying a high-pass frequency filter to the audio. The high-pass filter cuts off frequencies below a certain threshold value (i.e., some bass notes, which require a significant amount of power). The high-pass filter can be adjusted based on the available power in the short-term energy storage 112 and the time-resolved power analysis of the audio. For example, when a time-resolved power analysis of the audio can be retrieved prior to playing the audio, a specific setting for a high-pass filter for that particular audio content can be determined and set before the audio starts playing, to ensure that there is sufficient power to the speaker 118. In a situation where the power consumption is monitored continuously while playing particular audio content, the cutoff frequency for the high-pass filter can be adjusted dynamically. For example, if the sensing circuitry 114 indicates that the short-term energy storage 112 is being depleted too fast, then the high-pass filter can be moved up in the frequency realm, such that more lower frequencies or bass notes are being eliminated. Conversely, if the short-term energy storage 112 remains full, it may make sense to allow more of the lower frequencies through the high-pass filter. The exact dynamics of how this fine-tuning is accomplished lies well within the capabilities of those having ordinary skill in the art.

Another tool offered by the DSP 110 is a compressor, which can adjust the dynamic range of the audio. The dynamic range can be described as the difference between the sound's loudest and quietest moments over the duration of the audio content. By compressing the dynamic range, the louder and quieter sounds come closer to each other in level. Typically, this is done through so-called "downward compression," in which the audio is attenuated when too much power is consumed. The compressor can be calibrated such that the "attack time" of the compressor (i.e., how quickly the compressor reacts to a "power surge" in the audio), before the downward compression occurs, is not longer than what can be handled by the short-term energy storage 112. Conversely, there is also a corresponding "release time" which needs to be sufficiently long to allow the short-term energy storage to recharge (at least to some pre-determined level) before the downward compression is reduced by the DSP 110. Again, the exact dynamics of how this fine-tuning is accomplished lies well within the capabilities of those having ordinary skill in the art.

Finally, in case either (or a combination) of the above measures are not sufficient, the output gain (i.e., the overall volume) is lowered as a last step prior to the short-term energy storage 112 getting depleted, in order to avoid a shutdown of the device. Lowering the overall volume has a much more significant impact on the listening experience for the user, so this is typically saved as a last resort before the short-term energy storage 112 becomes empty.

These are merely a few examples of possible embodiments, and many more will be readily available to those having ordinary skill in the art. For example, in some embodiments, there may be a time window, which specifies a minimum duration for any of the above measures. Having such a minimum time window may avoid, for example, a situation where the bass is skipped in every other measure of a music piece, which would sound awkward to a listener. Other techniques could be applied. For example, the tonic could be eliminated and only the overtones kept, which psychoacoustically is perceived by a listener as the tonic still being present. As can be seen, there are many variations that can be implemented by persons having ordinary skill in the art and based on the particular situation at hand.

The systems and methods disclosed herein can be implemented as software, firmware, hardware or a combination thereof. In a hardware implementation, the division of tasks between functional units or components referred to in the above description does not necessarily correspond to the division into physical units; on the contrary, one physical component can perform multiple functionalities, and one task may be carried out by several physical components in collaboration.

Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It will be appreciated that a person skilled in the art can modify the above-described embodiments in many ways and still use the advantages as shown in the embodiments above. Thus, the teachings should not be limited to the shown embodiments but should only be defined by the appended claims. Additionally, as the skilled person understands, the shown embodiments may be combined.

What is claimed is:

1. A method for controlling a speaker, the speaker being electrically powered with a low-power source, and being connected to a short-term energy storage, comprising:

receiving audio for playback on the speaker;

acquiring a time-resolved power analysis of the audio and calculating a time-resolved speaker power requirement required by a speaker playing back the audio;

comparing the time-resolved speaker power requirement with a combined capacity of the low-power source and the short-term energy storage; and adjusting one or more of: a dynamic range, a frequency range, and an output gain of a digital signal processor, such that the speaker power requirement meets the combined capacity of the low-power source and the short-term energy storage for the duration of a playback of the received audio on the speaker, wherein the adjusting comprises adjusting a sound profile of the audio by adjusting one or more of the dynamic range and the frequency range, and wherein the output gain is adjusted only upon the adjustment of the one or more of the dynamic range and the frequency range not being sufficient to meet the combined capacity of the low-power source and the short-term energy storage for the duration of a playback of the received audio on the speaker.

2. The method of claim 1, wherein the low-power source is a Power over Ethernet power source.

3. The method of claim 1, wherein the short-term energy storage is located inside the speaker.

4. The method of claim 1, wherein the short-term energy storage includes one or more capacitors, or one or more batteries.

5. The method of claim 1, wherein acquiring a time-resolved power analysis of the audio includes retrieving the time-resolved power analysis of the audio from a database.

6. The method of claim 1, wherein acquiring a time-resolved power analysis of the audio includes performing a time-resolved power analysis of the audio as the audio is being played back on the speaker.

7. The method of claim 6, further comprising:

optimizing the acquired time-resolved power analysis to ensure that the power requirement of the received audio meets the combined capacity of the low-power source and the short-term energy storage during a subsequent playback of the received audio on the speaker.

8. The method of claim 1, wherein adjusting a frequency range includes applying a high-pass frequency filter to reduce a range of low frequency audio being played back on the speaker.

9. The method of claim 1, wherein adjusting a dynamic range includes performing a downward compression of the received audio.

10. The method of claim 1, further comprising:

continuously monitoring the combined capacity of the low-power source and the short-term energy storage; and wherein the adjusting is performed continuously in response to the monitoring such that the power requirement of the speaker meets the combined capacity of the low-power source and the short-term energy storage for the duration of a playback of the received audio on the speaker.

11. The method of claim 10, wherein the adjusting is performed in response to detecting an increasing or decreasing trend in the combined capacity of the low-power source and the short-term energy storage.

12. The method of claim 1, wherein the adjusting is done based on the type of received audio.

13. A system for controlling a speaker, the system comprising:

a speaker;

a low-power source powering the speaker;

a short-term energy storage connected to the speaker;

a digital signal processor;

a memory; and a processor, wherein the memory contains instructions that when executed by the processor causes the processor to perform a method that includes:

receiving audio for playback on the speaker;

acquiring a time-resolved power analysis of the audio and calculating a time-resolved speaker power requirement required by a speaker playing back the audio;

comparing the time-resolved speaker power requirement with a combined capacity of the low-power source and the short-term energy storage; and adjusting one or more of: a dynamic range, a frequency range, and an output gain of the digital signal processor, such that the speaker power requirement meets the combined capacity of the low-power source and the short-term energy storage for the duration of a playback of the received audio on the speaker, wherein the adjusting comprises adjusting a sound profile of the audio by adjusting one or more of the dynamic range and the frequency range, and wherein the output gain is only adjusted upon the adjustment of the one or more of the dynamic range and the frequency range not being sufficient to meet the combined capacity of the low-power source and the short-term energy storage for the duration of a playback of the received audio on the speaker.

14. A computer program product for controlling a speaker, the speaker being electrically powered with a low-power source, and being connected to a short-term energy storage, the computer program product comprising a non-transitory computer readable storage medium having program instructions embodied therewith, the program instructions being executable by a processor to perform a method comprising:

receiving audio for playback on the speaker;

acquiring a time-resolved power analysis of the audio and calculating a time-resolved speaker power requirement required by a speaker playing back the audio;

comparing the time-resolved speaker power requirement with a combined capacity of the low-power source and the short-term energy storage; and adjusting one or more of: a dynamic range, a frequency range, and an output gain of a digital signal processor, such that the speaker power requirement meets the combined capacity of the low-power source and the short-term energy storage for the duration of a playback of the received audio on the speaker, wherein the adjusting comprises adjusting a sound profile of the audio by adjusting one or more of the dynamic range and the frequency range, and wherein the output gain is only adjusted upon the adjustment of the one or more of the dynamic range and the frequency range is not sufficient to meet the combined capacity of the low-power source and the short-term energy storage for the duration of a playback of the received audio on the speaker.

* * * * *